United States Patent [19]

Sharp

[11] Patent Number: 4,462,198

[45] Date of Patent: Jul. 31, 1984

[54] SUSPENDED CEILING SYSTEM

[75] Inventor: Joseph F. Sharp, Norwalk, Calif.

[73] Assignee: Ceiling Dynamics, Inc., Tucson, Ariz.

[21] Appl. No.: 250,583

[22] Filed: Apr. 3, 1981

[51] Int. Cl.[3] ..... E04C 2/42

[52] U.S. Cl. ..... 52/667; 52/484

[58] Field of Search ..... 52/484, 667, 668, 666, 52/664; 403/347

[56] References Cited

U.S. PATENT DOCUMENTS

| | | | |
|---|---|---|---|
| 3,374,596 | 3/1968 | O'Brien et al. | 52/484 X |
| 3,501,185 | 3/1970 | Brown et al. | 52/664 |
| 3,846,031 | 11/1974 | Adams | 52/484 X |
| 4,021,986 | 5/1977 | McCall et al. | 52/484 X |

*Primary Examiner*—Carl D. Friedman

*Attorney, Agent, or Firm*—Eugene Chovanes

[57] ABSTRACT

A suspended ceiling system for supporting ceiling panels and the like includes a plurality of main runners, connected in end-to-end relationship to form parallel beams, and a plurality of cross runners interconnecting the parallel beams to form a grid.

Each main runner includes an end connector, having an opposed pair of laterally projecting hooks which form a guideway for receipt of the forward end of a corresponding main runner end connector. The face of each end connector is continuous, from one side of the hooks to the other, to provide a bearing surface for sliding the end connectors through their respective guideways. Respective apertures and detents are formed in each end connector to provide opposed engaging surfaces for interlocking the end connectors in side-by-side relationship.

The cross runners include respective end connectors which interlockingly engage when inserted from opposite directions through a slot in the web of the main runner. In a first embodiment, respective apertures, formed in the tongue of each end connector, engage respective detents or dimples projecting laterally from the side of each end connector. In a second embodiment, respective T-shaped tongues engage respective lateral projections formed in the side of each end connector.

A flange, projecting laterally from each cross runner end connector, bears against the main runner support flange to support the cross runners on the main runners, with the cross and main runner support flanges abutting, and their respective support surfaces lying in a common plane throughout their length.

2 Claims, 8 Drawing Figures

FIG. 7
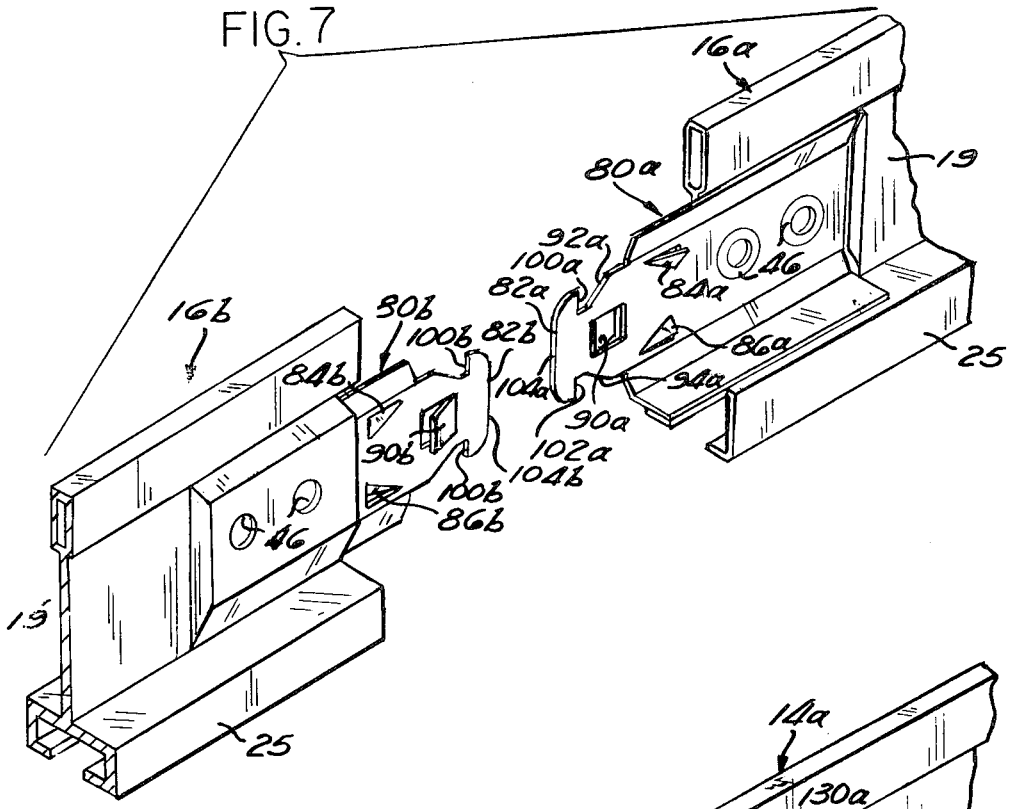
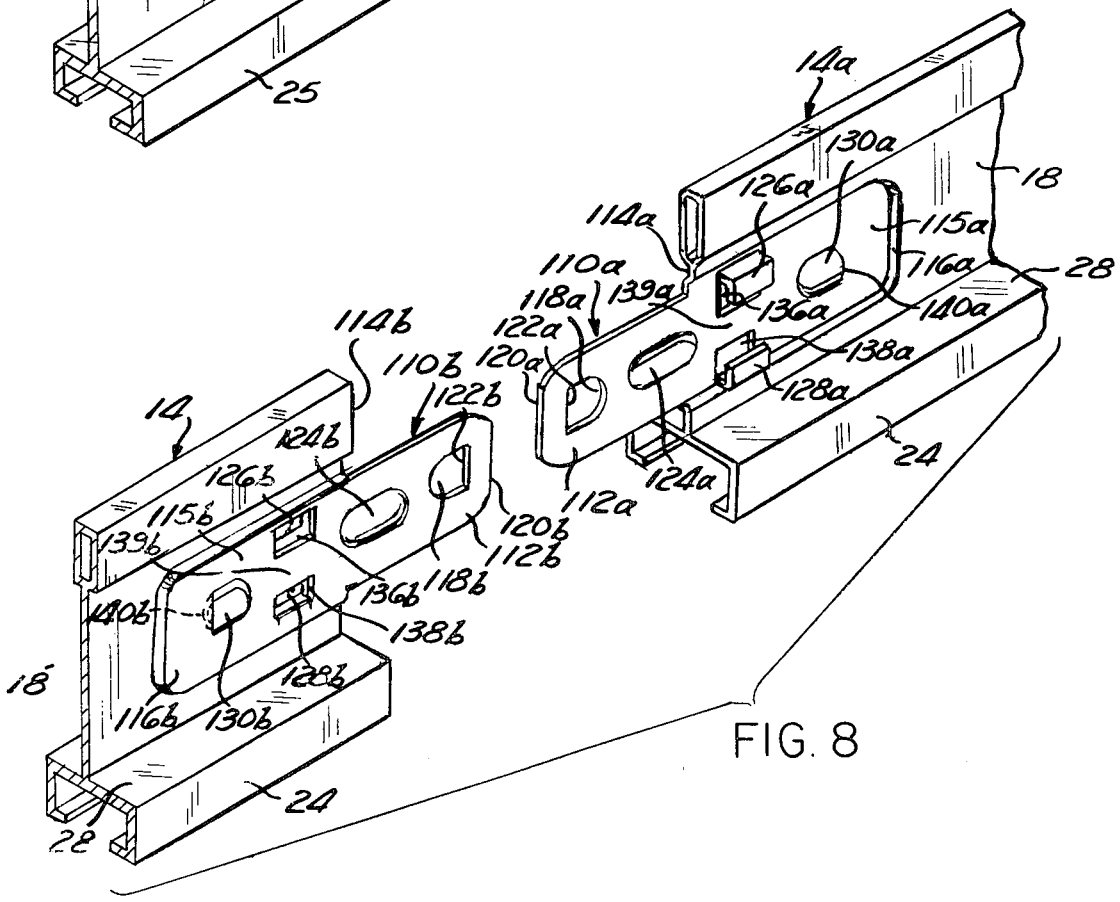
FIG. 8

SUSPENDED CEILING SYSTEM

BACKGROUND OF THE INVENTION

The present invention relates to suspended ceiling systems and particularly to connection systems for interlocking the main runners and cross runners of such suspended ceiling systems.

The main runners and cross runners of suspended ceiling systems are typically comprised of a web portion with a panel supporting flange portion at its lower edge. The main runners are connected in end-to-end relationship to form parallel runs while the cross runners are connected perpendicularly between the main runners. Thus, the interconnected cross and main runners cooperate to form a grid system for supporting ceiling panels.

Interconnection of the cross runners with the main runners is usually accomplished by forming a tongue-shaped connector on the end of each cross runner, which is received by a slot in the web of the main runner. Various types of locking systems are provided to fasten the end connector to the main runner web or to the end connector of an opposed cross runner. One such interlocking system is disclosed in U.S. Pat. No. 4,108,563, issued to Brown et al.

It is desirable for aesthetic reasons to interconnect the cross and main runners so that their ceiling panel support flanges lie in the same plane. This may be accomplished by properly orienting the slots and end connectors so that the end connectors are supported by the slots at a level which permits the cross runner support flange to abutt the main runner support flange. However, this method of aligning the flanges is disadvantageous, since it requires that the positioning of the notch in the web, and the positioning of the connector on the cross runner, be within relatively exact tolerances to insure accurate alignment of the panel support flanges. The prior art has responded to this problem by extending the cross runner flange so that it overlaps or overrides the top of the main runner flange. Typically, the end of the cross runner flange is bent to form a jog, so that it is raised above the central plane of the flange by an amount equal to its thickness, as illustrated in U.S. Pat. No. 3,501,185, issued to Brown et al. This permits the main and cross runner flanges to lie in the same plane, except at the point of overlap, where the jogged overlapping portion of the cross runner flange lies above this plane. The jog, however, creates a raised portion which is equal in height to the thickness of the cross runner flange. This raised portion is disadvantageous, since it prevents the ceiling panels from lying flush against the flanges throughout their length. Moreover, it is impractical to reduce the height of this raised portion by making the cross runner flange very thin, since the flanges must have a reasonable degree of structural strength to provide proper support for the ceiling panels.

As with cross runners, interconnection of main runners is typically accomplished by providing interlocking end connectors. It is common in the prior art to provide a strap or loop which extends perpendicularly outward from the side of the end connector, as shown in U.S. Pat. No. 3,979,874, issued to Cubbler, Jr., et al. The loop receives the end connector of an adjacent main runner and holds the end connectors together, in side-by-side relationship, to prevent lateral separation. However, for manufacturing convenience, the loop is usually formed by lancing the side of its end connector, which creates an aperture. When the leading edge of the adjacent end connector is inserted through the loop, it may catch on the side of the aperture, thereby making assembly difficult.

SUMMARY OF THE INVENTION

The present invention comprises a suspended ceiling system which permits (a) the cross and main runner flanges to both lie in the same horizontal plane; (b) the cross runner to be vertically supported by the main runner flange without reliance on the slot in the web of the main runner; and (c) the ceiling panels to lie substantially flush against the flanges, regardless of the thickness of the cross runner flange.

This is accomplished by providing a lateral support flange, formed integrally with, and projecting generally perpendicularly from, the lower edge of the cross runner end connector. This end connector is sized so that, after it is inserted into the slot of the main runner web, the lateral support flange bears on the main runner flange. Consequently, the overlapping of the cross runner flange onto the main runner flange, associated with some prior art grid systems, is eliminated. This permits the cross and main flanges to be oriented in abutting relationship with their upper surfaces, i.e., their ceiling panel support surfaces lying in the same horizontal plane throughout their length. Although the lateral flange has a minimal thickness, this thickness is so small as to be negligible, since the end connectors are formed from thin sheet metal. Thus, this flange does not prevent the ceiling panels from fitting substantially flush against the panel support flanges. Consequently, the raised portions of the prior art grid systems, caused by the overlapping of the panel support flanges, are virtually eliminated. Elimination of such overlapping is also advantageous from a manufacturing viewpoint, since it is much easier to form the lateral flange on the end connector than it is to form the jog in the cross runner, panel support flange. Further, use of this end connector flange permits accurate alignment of the panel support flanges without the need to precisely position the notch on the main runner web and without need for precise tolerances in attaching the end connector to the cross runner. Thus, the present invention creates substantial manufacturing efficiencies.

In addition to providing support for the cross runner, the end connector flange also advantageously serves to stiffen the end connector to prevent it from bending in response to lateral forces. This insures that the opposing cross runners, when inserted from opposite directions into the web of the main runner, will lie in the same vertical plane, and thus, insures that the grid system will not become misaligned.

The end connectors of the main runners of the present invention each have a pair of opposed L-shaped members projecting from the side thereof. These L-shaped members form a guide for receiving the end connector of an adjacent main runner, and also function to hold the end connectors against each other to prevent lateral separation. The L-shaped members are advantageously formed by lancing the end connector to create a tab, and bending this tab to the desired L-shape. This, of course, creates apertures in the end connectors, beneath each of the L-shaped members. However, it is significant that a portion of material remains between the L-shaped members, which advantageously prevents the leading edge of the adjacent end connector from catching on these apertures when the adjacent end connector is slid between the L-shaped members. This permits the main runners to be assembled quickly and easily, with minimal manipulation.

BRIEF DESCRIPTION OF THE DRAWINGS

These and other advantages of the present invention are best understood through reference to the drawings, in which:

FIG. 1 is a partial perspective view of the main and cross runners of the present invention interconnected to form a grid, suspended by hangers from an overhead structure, for supporting ceiling panels or the like;

FIG. 7 is a partial perspective view of two cross runners of a second embodiment of the present invention showing their respective end connectors; and FIG. 8 is a partial perspective view of two main runners of the present invention showing their respective end connectors positioned for interconnection in end-to-end relationship.

DETAILED DESCRIPTION OF THE PREFERRED EMBODIMENTS

Figure 1:
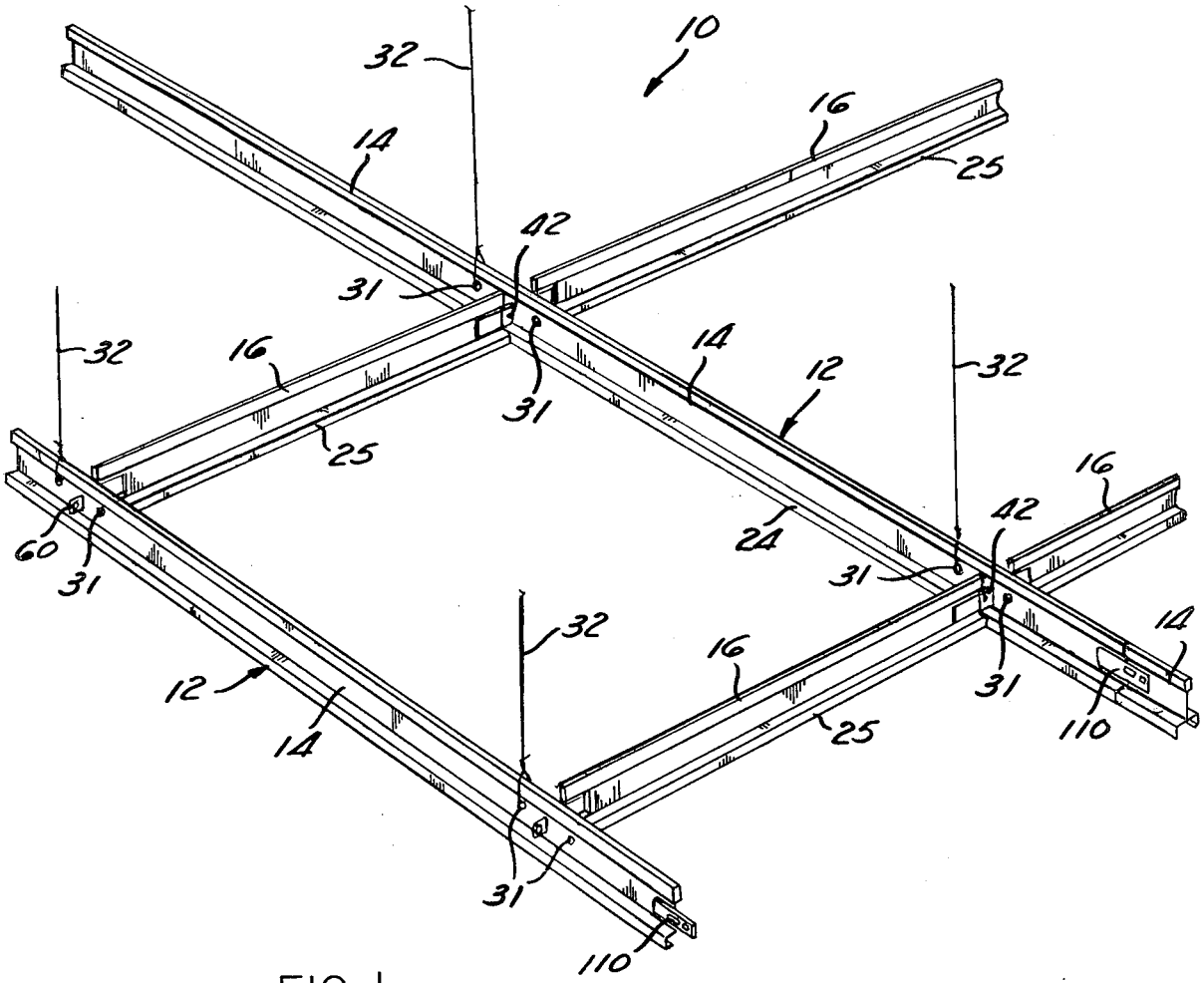

Referring to FIG. 1, the suspended ceiling system of the present invention comprises a grid system 10 for supporting ceiling panels (not shown). The grid system 10 includes a plurality of longitudinal beams 12, in spaced parallel relationship, with each longitudinal beam 12 comprising one or more main runners 14, connected in end-to-end relationship. A plurality of cross runners 16 are positioned in parallel spaced relation, normal to and interconnecting adjacent parallel longitudinal beams 12. Thus, the main runners 14 and cross runners 16 cooperate to form the grid 10.

Apertures 31 are formed in the web portion 18 of each main runner 14 to permit the grid system 10 to be suspended from a conventional ceiling or overhead structure by a plurality of wire hangers 32 which are secured to the grid system 10 through selected ones of the apertures 31, as shown in FIG. 1.

Hereinafter, the suffixes "a" and "b" will be appended to the reference numerals to designate the exemplary pairs of cross runners, shown in FIGS. 2 through 7, and the exemplary pair of main runners, shown in FIG. 8. Thus, for example, the cross runners of FIGS. 2 through 7 will be referred to generally as 16 and individually as **16*a* and 16*b*. This same convention will be followed for the component parts and portions comprising the cross runners 16 and main runners 14. In addition, when the terms "vertical" and "horizontal" are used hereinafter in reference to the cross runners 16 and main runners 14, it will be assumed that the runners 14,16 are lying in a common horizontal plane, as they are when assembled in the grid system 10**.

Figure 2:
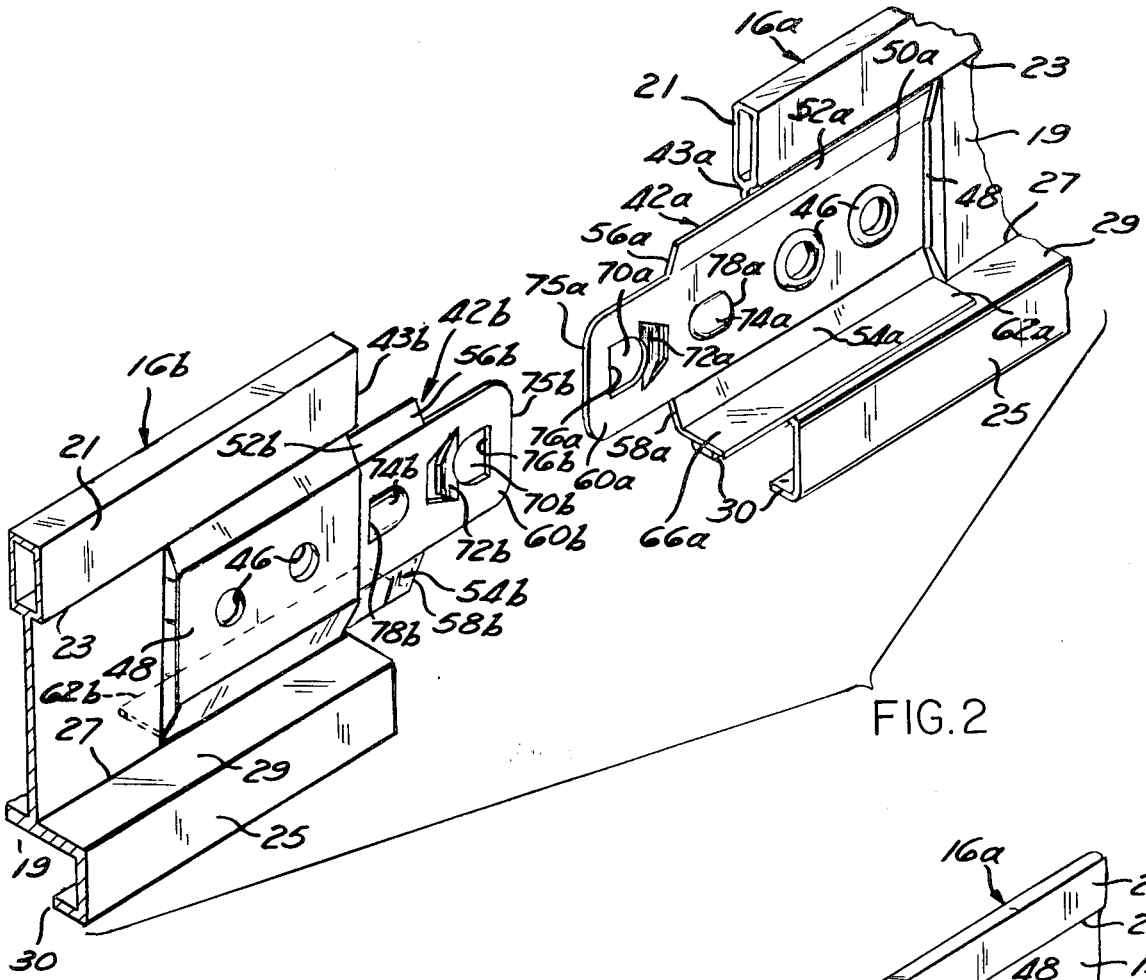
FIG. 2 is a partial perspective view of two cross runners of the present invention showing their respective end connectors.
Figure 3:
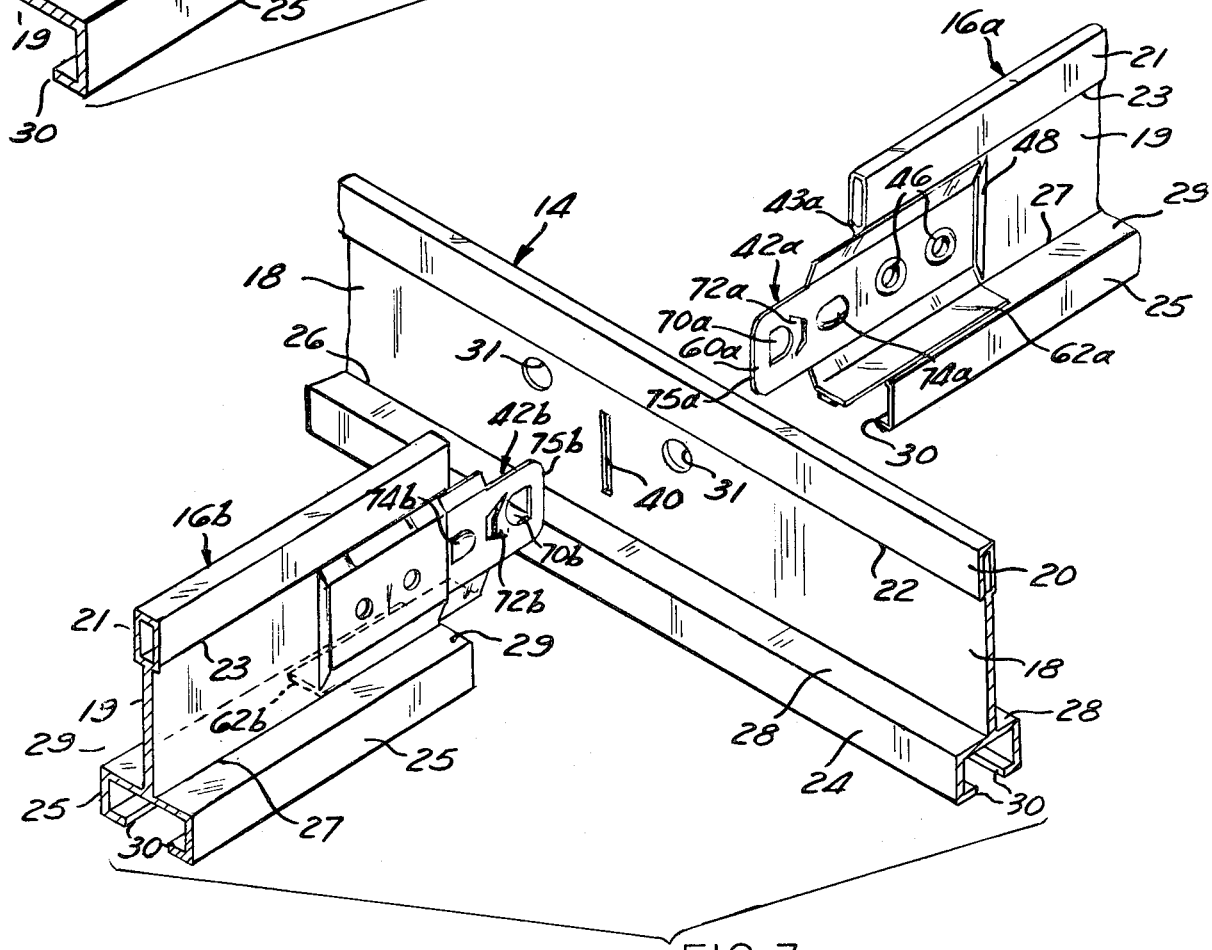
FIG. 3 is a partial perspective view of the cross runners of FIG. 2 showing their end connectors positioned for insertion into a slot in the main runner.

Referring to FIGS. 2 and 3, each of the main runners and cross runners 16 include intermediate elongated web portions 18,19, respectively, having longitudinally extending box portions 20,21, respectively, formed along the upper edges 22,23, respectively, thereof, and longitudinally extending flange portions 24,25, respectively, formed along, and coextensive with, the lower edges 26,27, respectively, thereof. The flange portions 24,25 have upper surfaces 28,29, respectively, projecting perpendicularly from the web portions 18,19, respectively, for supporting the ceiling panels. These flanges 24,25 may be C-shaped, having an opening 30 opposite its point of connection with the web portions 18,19, respectively, as shown in the drawings. However, it will be understood that the flange portions 24,25, as well as the box portions 20,21, may have other shapes. For example, it is common for the flange portions 24,25 to comprise flat members which cooperate with the web portion to form an inverted T. In any case, the cross section of the cross runners 16 is preferably identical with the cross section of the main runners 14 to reduce inventory and tooling requirements. Further, the main and cross runners 14,16 are preferably uniform in cross section, with their respective upper edges 22,23 parallel to their respective lower edges 26,27, throughout their length, for ease of manufacture. Moreover, the flange portions 24,25 are preferably straight throughout their length, without jogs or bends, also for ease of manufacture. The runners 14,16 may be produced by any one of a variety of processes, such as extrusion, or forming from sheet stock.

A vertical slot 40 is formed in the web portion 18 of the main runner 14. The slot 40 receives an end connector **42*a*, mounted to project from the end 43*a* of the cross runner 16*a*, and an end connector 42*b* mounted to project from the end 43*b* of the cross runner 16*b*. The end connectors 42 are inserted into the slot 40 from opposite directions, as shown in FIG. 3, and interlock in a manner which permits the cross runners 16 to lie in the same vertical plane, generally perpendicular to the vertical plane of the main runner 14. The slot 40 is rectangular in shape and does not include any projections, protrusions, or irregularities which might interfere with or be damaged by the insertion of the cross runners 16 therein. Since the cross runners 16** are all identical in structure, a description of one of the cross runners should be understood to apply equally to the others.

The end connectors 42 are preferably formed by stamping them from sheet metal stock, and are mounted on the webs 19 of the respective cross runners 16 by rivets 46. However, it will be recognized that the connectors 42 may be formed in other ways, for example, as an integral part of the cross runner 16. The end connectors 42 are each mounted in a recessed portion 48 so that, when the end connectors 42*a* and 42*b* are inserted from opposite directions into the slot 40, the engaging faces of the connectors 42 will align with the central plane of the cross runner web portions 19 to ensure alignment of the connected cross runners 16.

As best seen in FIG. 2, the end connector 42*a* comprises a rectangular base portion 50*a*, and a tongue portion 60*a*. Opposed wing flanges 52,54*a* project from the top and bottom, respectively, of the base portion 50*a*. These flanges 52*a*,54*a* are sized and shaped to permit the end connector base portion 50*a* to fit flush against the face of the recessed portion 48*a*. Both flanges 52*a*,54*a* extend past the end 43*a* of the cross runner 16*a* by an amount approximately equal to the width of the surface 28 of the main runner flange 24, where they abruptly terminate to form edges 56*a*,58*a*, respectively, at right angles to the base portion 50*a*. However, the end connector 42*a* extends past the flange edges 56*a*,58*a* to form the tongue portion 60*a*, adjacent to the central portion 50*a*.

The slot 40 is only slightly larger in height than the tongue portion 60*a*. Thus, when the connector 42*a* is inserted into the slot 40, the tongue portion 60*a* will travel through the slot 40 until the edges 56*a*, 58*a* abutt the web 18 to prevent further movement therethrough. Since the wing flanges 52*a*,54*a* extend past the end 43*a* of the cross runner 16*a* by an amount approximately equal to the width of the surface 28 of the main runner flange 24, the main runner flange 24 and cross runner flange 25 will abutt when the tongue portion 60*a* is fully inserted into the slot 40. This abuttment of the flanges 24 and 25 also prevents further movement of the cross runner 16*a* towards the main runner 14.

Figure 4:
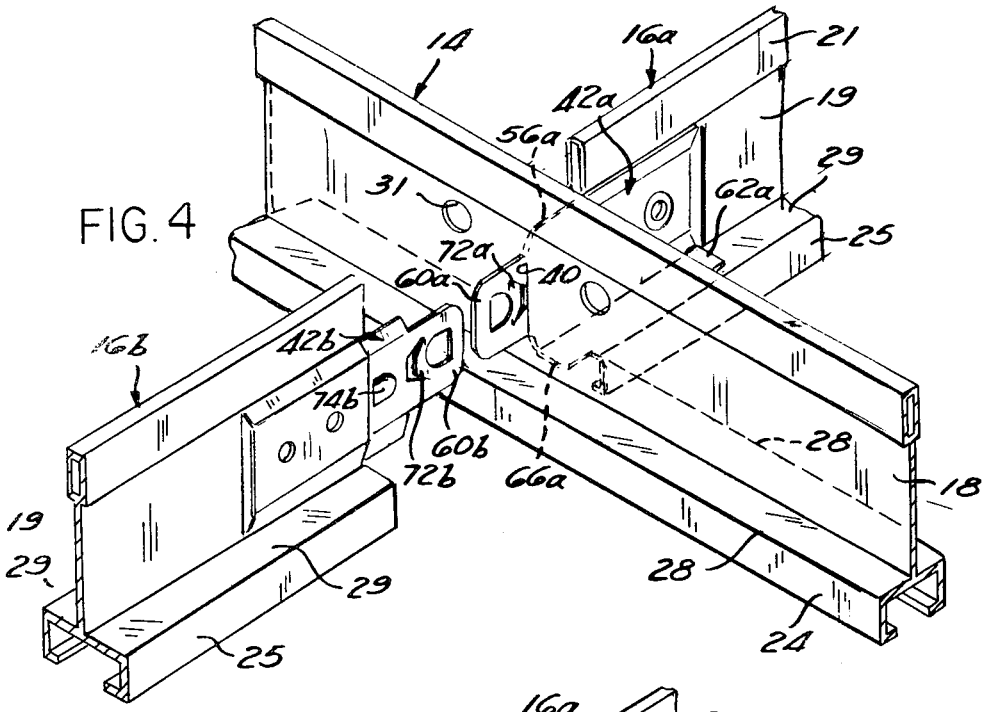
FIG. 4 is a partial perspective view of the cross runners and main runner of FIG. 3, with one of the end connectors inserted into the main runner slot, showing the tab of said one end connector engaging the main runner web, and cooperating with the wing flange edges of said one end connector, to lock said one end connector in the main runner slot, prior to insertion of the other end connector.
Figure 5:
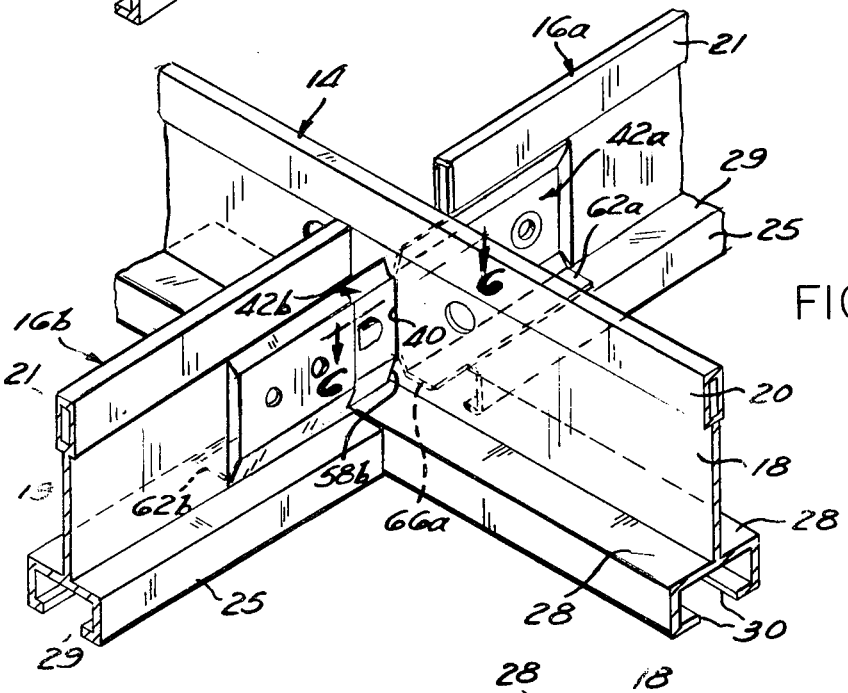
FIG. 5 is a partial perspective view of the cross runners and main runner of FIG. 4 with both end connectors inserted into the main runner slot showing the end connector wing flanges abutting the main runner web to prevent movement of the end connectors toward each other, and showing the ceiling panel support surfaces of the main and cross runners lying in a common plane with their support flange abutting.

The connector 42*a* includes an integrally formed plate or flange 62*a* which projects laterally from the lower edge of the wing flange 54*a* and bears flush against the upper surface 29 of the panel support flange 25. This end connector flange 62*a* extends past the edge 43*a* of the cross runner 16*a* by a distance slightly less than the distance that the wing flange 54*a* extends past this edge 43*a* to provide an extended portion 66*a*. The slot 40 is oriented so that, when the tongue portion 60*a* is fully inserted therein, the extended portion 66*a* of the cross runner support flange 62*a* will bear against the surface 28 of the main runner, panel support flange 24. Thus, the lateral flange 62*a* acts to support the cross runner 16*a* on the main runner 14. Further, since the flange 62*a* bears against the surfaces 29,28 of both panel support flanges 25,24, respectively, and bridges the abuttment between them, the panel support flange surfaces 29,28 will lie in the same plane throughout their length, as best seen in FIGS. 4 and 5. Moreover, this flange 62*a* is preferably formed of sheet metal, substantially thinner than the flanges 25,24, and thus, does not prevent the ceiling panels from lying substantially flush against the surfaces 29,28. Although the foregoing structural and functional relationships were described in connection with the end connector 42*a*, it will be understood that the same relationships apply as well to the end connector 42*b*.

It will be recalled from the discussion in reference to FIG. 1 that each cross runner 16 is connected between parallel beams 12 formed by main runners 14. Thus, each cross runner 16 will have two end connectors 42, one at each end. Since these two end connectors 42 are preferably identical, their respective lateral flanges 62 will be oriented to project in opposite directions. Thus, for example, one of these flanges 62 will be oriented in the direction of the flange 62*b* of FIG. 3, while the other flange 62 will be oriented in the direction of the flange 62*a* of FIG. 3. This is advantageous since, if the cross runner is rotated about its central axis, one of the lateral flanges 62 will co-act with the panel support surface 28 of one main runner 14 to resist rotation in one direction, while the other lateral flange 62 will co-act with the panel support surface 28 of the other main runner 14 to resist rotation in the other direction. Thus, the lateral flanges 62 cooperate to prevent the cross runners 16 from rotating relative to the main runners 14.

An interlocking system is provided for locking the connectors 42*a* and 42*b* to the main runner web 18 as well as to each other. Using the connector 42*a* as an example, the locking system comprises an aperture 70*a*, a tab 72*a*, and a dimple or detent 74*a*, all of which are spaced along the central longitudinal axis of the connector 42*a*. The aperture 70*a* is formed in the tongue portion 60*a*, near its forward or leading edge 75*a*. This aperture 70*a* is more or less semicircular in configuration, having a straight vertical edge 76*a* which faces away from the leading edge 75*a* of the connector 42*a*. The dimple 74*a* is positioned in the base portion 50*a*, between the wing flanges 52*a* and 54*a*, and also between an imaginary line connecting the flange edges 56*a*,58*a*, and the end 53*a* of the cross runner 16*a*. This dimple 74*a* is formed by cutting and laterally deforming the end connector material to create an edge 78*a* which: (i) projects laterally from the side of the connector 42*a*, and (ii) is oriented to face in the same direction as the edge 76*a*. The remaining portions of the dimple 74*a*, however, blend from the plane of the connector 42*a* and thus, provide a smooth transition from the connector 42*a* to the laterally projecting edge 78*a*. The tab 72, which is more or less trapezoidal in shape, is formed by lancing the end connector 42*a* and bending the lanced portion laterally therefrom, so that it projects from the side of the connector 42*a* opposite the dimple 74*a*. This tab 72*a* is positioned in the tongue portion 60*a* between the aperture 70*a* and the imaginary line connecting flange edges 56*a*,58*a*. Further , the distance, measured along the connector central axis, between the tab 72*a* and the imaginary line connecting flange edges 56*a*,58*a* is slightly greater than the thickness of the main runner web 18.

During assembly of the grid system 10, one of the end connectors 42 is inserted into the slot 40, prior to the other end connector, as shown in FIG. 4. Again, using the end connector 42*a* as an example, such insertion is accomplished merely by aligning the tongue 60*a* in the slot 40 and pushing the connector 42*a* therein with a straight in movement. Since the axial distance between the tab 72*a* and the flange edges 56*a*,58*a* is slightly greater than the thickness of the main runner web 18, the tab 72*a* will cam inward and then spring outward to engage the side of the web 18 opposite the runner 16*a* when the connector 42*a* reaches its installed position. Simultaneously, the flange edges 56*a*,58*a* will abutt the web 18. Thus, the tab 72*a* and edges 56*a*,58*a* cooperate to lock the cross runner 16*a* in place relative to the main runner 14. Typically, this tab 72*a* merely provides a temporary lock prior to insertion of the end connector 42*b* from the opposite direction. However, it should be recognrized that the tab 72*a* may function to lock a single connector in the slot 40, even when a second connector is not installed.

Once the end connector 42*a* has been installed, the connector 42*b* is inserted into the slot 40 from the opposite direction, again, by straight in movement, as shown in FIG. 5. Viewed from the perspective of FIGS. 4 and 5, the connector 42*b* is inserted through the slot 40 to the right of the connector 42*a*. This is necessary to ensure that the cross runners interlock properly. In this regard, it will be recognized that the tab 72*a*, which extends to the left of the slot 40, as viewed from FIG. 4, also functions to prevent the end connector 42*b* from being inserted on the wrong side of the slot 40.

Since the end connectors 42 are identical, it will be understood that the end connector 42*b* will have corresponding components, such as an aperture 70*b* with an edge 76*b*, a tab 72*b*, a simple 74*b* with an edge 78*b*, flanges 52*b*,54*b* with edges 56*b*,57*b*, a cross runner support flange 64*b* with a bearing portion 66*b*, a central portion 50*b*, and a tongue portion 60*b* with a leading edge 75*a*, as best seen in FIG. 2.

Figure 6:
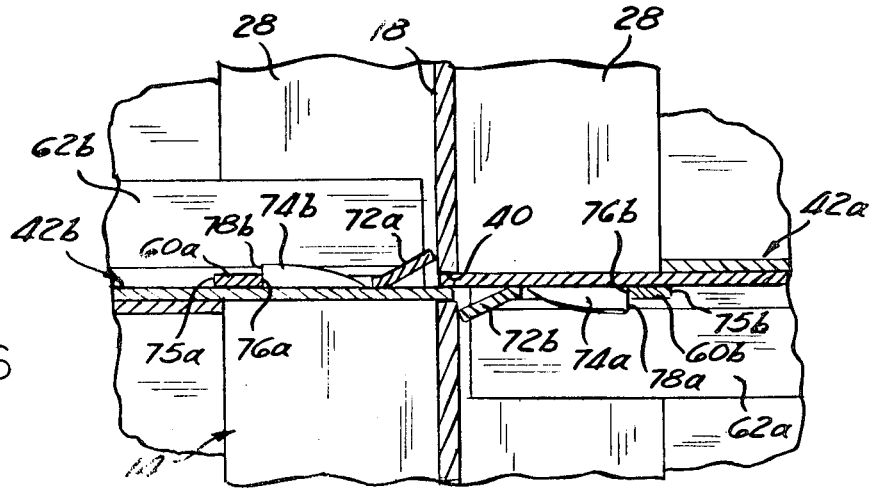
FIG. 6 is a fragmentary sectional view, taken substantially along the lines 6—6 of FIG. 5, of the main runner and end connectors of the cross runners of FIG. 5 showing generally the interlocking system of the present invention, and specifically the end connector tabs engaging the main runner web and the aperture edges engaging the dimple edges to prevent axial movement of the cross runners away from each other.

Referring to FIGS. 5 and 6, as the end connector 42*b* is inserted through the slot 40, one surface of the connector 42*b* will slide along the corresponding surface of the connector 42*a* until the leading edge 75*b* of the tongue portion 60*b* engages the dimple 74*a*. At this point, further movement of the connector 42*b* will cam the tongue portion 60*b* laterally outward until the edge 76*b* of the aperture 70*b* clears the edge 78*a* of the dimple 74*a*, at which time the tongue portion 60*b* snaps back against the connector 42*a* so that the dimple 74*a* protrudes through the aperture 70*b* with the edges 78*a* and 76*b* interengaging. The interengaging edges 76*b*, 78*a* are prevented from separating laterally by the slot 40. It will be recognized that, although the foregoing describes the interaction of the end connector 42*b* as it slides against the end connector 42*a*, the description is equally applicable to the action of the end connector 42*a* as it slides against the end connector 42*b*. Thus, in addition to the surfaces 76*b*,78*a* interengaging, it will be understood that the surfaces 76*a* and 78*b* also interengage in this same manner at the same time. Such interengagement prevents axial movement of the end connectors 42, and thus the cross runners 16, away from each other. While this interengagement does not prevent axial movement towards each other, it will be recalled that the flange edges 56,58 abutt the main runner web to prevent such movement of the cross runners 16 toward each other.

In a second embodiment of the present invention, shown in FIG. 7, a pair of end connectors 80*a*,80*b* are connected by the rivets 46 to the cross runners 16*a*,16*b*, respectively. The end connectors 80*a*,80*b* are identical to the end connectors 42,42*b*, respectively, except for their interlocking system. More specifically, the apertures 70*a* and 70*b* have been replaced by straps 82*a* and 82*b*, respectively. Further, the dimples 74*a* and 74*b* have each been replaced by a pair of protrusions 84*a*,86*a* and 84*b*,86*b*, respectively. However, tabs 90*a*,90*b* are identical in both structure and function to the tabs 72*a*,72*b*, respectively, of the first embodiment. Using the end connector 80*a* as an example, the structure of these connectors 80 will be described in more detail. A T-shaped tongue 82*a* is formed by cutting opposed triangular notches 92,94 on the top and bottom edges, respectively, of the end connector 80*a*. The notches 92*a*,94*a* form vertical trailing edges 100*a*,102*a*, respectively, which lie in a common plane that is parallel to the forward or leading edge 104*a* of the tongue 82*a*. Thus, the edges 100*a*, 102*a*, and 104*a* cooperate to form the T-shaped tongue 82*a*.

The projections 84*a*,86*a* are formed by lancing the end connector 80*a* and bending the lanced portion laterally therefrom in a direction opposite the laterally projecting tab 90*a*. These projections 84*a*,86*a* are aligned vertically with each other, and are aligned horizontally with the edges 100*a*,102*a*, respectively.

The end connector 80*b* is identical to the end connector 80*a*, and thus, has corresponding portions, such as a tongue 82*b*. These end connectors 80*a*,80*b* function in basically the same manner as the end connectors 42*a*,42*b*. For example, when the end connector 80*a* is inserted into the slot 40 (FIG. 3) of the main runner web 18, the tab 90*a* engages the web 18 to temporarily hold the connector 80*a* in place while the connector 80*b* is inserted through the slot 40 on the right-hand side of the connector 80*a*. As the connector 80*b* is pushed through the slot 40, the tongue 82*b* will cam over the projections 84*a*,86*a* until the edges 100*a*,102*a* clear the projections 84*a*,86*a*. At this point, the strap 82*b* will snap back against the face of the end connector 80*a* and the edges 100*b*,102*b* will engage the projections 84*a*,86*a*. It will be understood that the end connector 80*b* functions in a manner corresponding to the end connector 80*a* to cause the edges 100*a*,102*a* to simultaneously engage the projections 84*b*,86*b*. Thus, the end connectors 80 interlock to prevent movement of the cross runners 16 away from each other, in the same manner as the end connectors 42.

Referring to FIG. 8, a pair of end connectors 110*a*,110*b* are connected to respective main runners 14*a*,14*b*. The end connectors 110 are generally rectangular, and are preferably formed by stamping from sheet metal. These connectors 110*a*,110*b* include respective tongue portions 112*a*,112*b* projecting longitudinally from the respective edges 114*a*,114*b* of the webs 18, and respective base portions 115*a*,115*b* mounted in respective recessed portions 116*a*,116*b* of the webs 18. The recessed portions 116 offset the end connectors 110 from the central plane of the webs 18 so that, when the main runners 14 are connected in end-to-end relationship, the engaging faces of the connectors 110 will align with the central plane of the web 18 to insure alignment of the connected main runners 14.

Using the end connector 110*a* as an example, the structural details of the end connectors 110 will be described. An aperture 118*a* is formed in the tongue portion 112, near its leading or forward edge 120*a*. This aperture 118*a* is more or less semicircular in configuration, having a straight vertical edge 122*a* which faces away from the forward or leading edge 120*a*. The tongue portion 112*a* also includes an elongated embossment or stiffening rib 124*a* which extends from a point near the aperture 118*a* to a point near the junction of the tongue portion 112*a* with the base portion 115*a*.

The base portion 115*a* includes a detent or dimple 130*a* and a pair of opposed L-shaped members or hooks 126*a*,128*a*, positioned between the dimple 130*a* and the tongue portion 112*a*. The members 126*a*,128*a* project laterally from the top and bottom, respectively, of the base portion 115*a* to form a pair of opposed grooves which provide a guideway for receiving the tongue portion 112*b* of the connector 110*b*. Each of these members 126*a*,128*a* may be formed by lancing the connector 110*a* in a generally U-shape, and bending the lanced portion outwardly in the shape of an L. This, of course, creates apertures 136*a*,138*a* beneath each of the members 126*a*,128*a*, respectively. However, it is significant that a portion 139*a* of the connector surface remains intact between these apertures 136*a*,138*a* to prevent the leading edge 120*b* of the connector 110*b* from catching therein when inserted through the guideway formed by the members 126*a*,128*a*. Thus, the portion 139*a* provides a bearing surface for sliding the tongue portion 112*b*.

The dimple 130*a* is formed by cutting and laterally deforming the end connector material to create an edge 140*a* which: (i) projects laterally from the side of the connector 110*a* in the same direction as the members 126*a*,128*a*; (ii) is oriented to face in the same direction as the aperture edge 122*a*; and (iii) is positioned on the opposite side of the opposed members 126*a*,128*a* as the aperture edge 122*a*. The remaining portions of the dimple 130*a* blend from the plane of the connector 110*a*, and thus, provide a smooth transition from the connector 110*a* to the laterally projecting edge 140*a*. In addition, the dimple 130*a* is aligned longitudinally with the aperture 118*a*.

The end connector 110*b* is preferably identical to the end connector 110*b*, and thus, the end connector 110*b* comprises corresponding portions, such as an aperture 118*b* with an edge 122*b*, a detent or dimple 130*b* with an edge 140*b*, a stiffening rib 124*b*, a pair of opposed L-shaped members 126*b*,128*b* which provide a guideway for receipt of the tongue portion 112*a*, and a bearing surface portion 139*b* for sliding the tongue 112*a* through the guideway.

To assemble the main runners 14*a*,14*b*, the leading edge 120*b* of the connector 110*b* is inserted into the guideway formed by the opposed L-shaped members 126*a*,128*a*. The runners 14*a*,14*b* are then pushed together so that the one surface of the connector 110*b* slides along the corresponding surface of the connector 110*a* until the leading edge 120*b* of the connector 110*b* engages the dimple 130*a*. At this point, further movement of the connector 110*b* will cam the tongue portion 112*b* laterally outward until the edge 122*b* of the aperture 118*b* clears the edge 140*a* of the dimple 130*a*, at which time the tongue portion 112*a* snaps back against the face of the connector 110*a*, so that the dimple 130*a* protrudes through the aperture 118*b* with the edges 122*b* and 140*a* interengaging. The interengaging edges 122*b*, 140*a* are prevented from separating laterally by the L-shaped members 126*a*,128*a*. It will be recognized that, although the foregoing describes the interaction of the end connector 110*b* as it slides against the end connector 110*a*, this description is equally applicable to the action of the end connector 110*a* as it slides against the end connector 110*b*. Thus, in addition to the edges 122*b*,140*a* interengaging, it will be understood that the edges 122*a* and 140*b* also simultaneously interengage in this same manner. Such interengagement prevents axial movement of the end connectors 110, and thus the main runners 14, away from each other. Axial movement towards each other is, of course, prevented by abuttment of the main runner ends 114.

The apertures 118 and dimples 130 are spaced relative to each other so that when the foregoing interengagement occurs, the main runner edges 114 will abutt. This abuttment prevents axial movement of the runners 14 towards each other. In addition, the apertures 118, dimples 130, and members 126,128 are oriented so that when the main runners 14*a*,14*b* are interengaged, as described above, their panel support surfaces 28 will lie in the same plane throughout their length.

Thus, the main runners 14 and cross runners 16 of the present invention cooperate to permit their respective ceiling panel support surfaces 28,29 to lie in a common plane, with their respective flanges 24,25 abutting, when the runners 14,16 are assembled into the grid 10.

In summary, the lateral flanges 62 of the cross runners 16 permit accurate alignment of the support surfaces 28,29 without the need to precisely position the notch 40 and without the need for precise tolerances in attaching the end connectors 42 to the cross runners 14. Further, the flanges 62 provide support for the cross runners 14 on the main runner flanges 24 without overlapping the flange 25 onto the flange 24, thereby eliminating the "raised" portions, associated with some prior art grid systems. This also advantageously permits the cross runner flange 25 to be coextensive with the web 19, and thus, simplifies manufacture of the cross runners 16. Although the flanges 62 bear against the surfaces 28,29, they are preferably formed of thin sheet metal, and thus, permit the ceiling panels to fit substantially flush against the support surfaces 28,29. Rotation of the cross runners 16 relative to the main runner 14 is resisted by the co-action of the flanges 62 with the main runner support surfaces 28. Moreover, the lateral flanges 62 permit end-to-side abuttment of the support flanges 25,24, and thus, the flanges 25,24 also serve to prevent movement of the cross runners 14 towards each other.

What is claimed is:

1. A suspended ceiling grid system, comprising:

A. a plurality of main runners for forming plural longitudinal beams in spaced, parallel relationship, each of said main runners comprising:
- a web, having upper and lower edges, and a vertical, rectangular slot therethrough; and
- a main runner support flange, connected to the lower edge of said web, having a support surface extending perpendicularly from said web;

B. a first cross runner for interconnecting a pair of adjacent longitudinal beams, comprising:
- a web, having upper and lower edges and
- a cross runner support flange connected to the lower edge of said web, having a support surface extending perpendicularly from said web; and C. a first end connector, mounted on and extending from one end of said web, at least a portion of which is sized to pass through said rectangular slot to connect said cross runner to one of said main runners, said first end connector including a flange formed thereon and projecting laterally therefrom, said flange bears against the cross runner support flange with at least a portion of said lateral flange oriented to bear against said main runner support flange when said first end connector is mounted on the cross runner and the cross runner is connected to said main runner, to support said cross runner on said main runner, with said cross runner support flange abutting said main runner support flange, and said support surfaces lying in a common plane throughout their length; and D. a second cross runner, having a second end connector;
- first means, on said end connector, for engaging said second end connector;
- second means, on said second end connector, for engaging said first end connector; and said first and second means interlocking said end connectors when said end connectors are inserted into said main runner slot from opposite directions to prevent movement of said cross runners away from each other independent of said main runner web;

wherein said first and second means each comprise:

a T-shaped tongue having a pair of trailing edges; and a pair of protrusions formed on the end connector, oriented to engage and be engaged by the trailing edges of the opposing end connector when said end connectors are inserted into said main runner slot from opposite directions a sufficient distance to permit the T-shaped tongue portion to slide past the protrusions, whereby withdrawal of either end connector from the slot is resisted by the end connector protrusions.

2. In a suspended ceiling grid system, an end connector, connected to a cross runner, for connecting said cross runner to a main runner by inserting said end connector through a slot in said main runner, said end connector comprising:

a T-shaped tongue portion defined by a leading edge and first and second trailing edges, said tongue portion having first and second projections aligned horizontally with said first and second trailing edges, respectively, said first and second projections engaging respective trailing edges of a similar, correspondingly configured end connector, and said first and second trailing edges engaging respective projections of said correspondingly configured and connector, when said end connectors are inserted into said main runner slot from opposite directions.

* * * * *